United States Patent [19]

Meyrat et al.

[11] Patent Number: 4,924,452

[45] Date of Patent: May 8, 1990

[54] WATCH PROVIDED WITH A DIAL

[75] Inventors: Clément Meyrat, Le Landeron; Antoine Dubois, Le Locle, both of Switzerland

[73] Assignee: ETA SA Fabriques d'Ebauches, Grenchen, Switzerland

[21] Appl. No.: 236,488

[22] Filed: Aug. 25, 1988

[30] Foreign Application Priority Data

Sep. 3, 1987 [CH] Switzerland ..... 3390/87

[51] Int. Cl.[5] ..... G04B 37/04; G04B 19/14

[52] U.S. Cl. ..... 368/236; 368/314

[58] Field of Search ..... 368/228, 232–237, 368/299–300, 314, 318

[56] References Cited

U.S. PATENT DOCUMENTS 1,338,745 5/1920 Maloney ..... 368/236
3,668,865 6/1972 Hirabayashi ..... 368/236
4,207,735 6/1980 Ishigaki et al. ..... 368/236
4,247,926 1/1981 Bachmann ..... 368/236
4,437,770 3/1984 Gogniat ..... 368/232

FOREIGN PATENT DOCUMENTS 2212573 7/1974 France .

*Primary Examiner*—Vit W. Miska
*Attorney, Agent, or Firm*—Sughrue, Mion, Zinn, Macpeak & Seas

[57] ABSTRACT

A watch with a case, a glass, a case band, a back, a movement, hands, a dial and means for positioning the dial in the watch.

The positioning means have a first part fixed and positioned axially, radially and angularly and a second part and associated with the periphery of the dial which cooperates with the stop of the first part to position the dial axially and angularly while still permitting radial deformation.

7 Claims, 2 Drawing Sheets

WATCH PROVIDED WITH A DIAL

FIELD OF THE INVENTION

The present invention relates to watches of the type having a case, a dial, hands and means for fixing the dial in the watch.

DESCRIPTION OF THE PRIOR ART

In conventional watches, the dial is of metal and generally has welded pins which engage in holes in the base plate and are secured to the latter by means of screws or dial screws. In this case the decoration is achieved by means of appliques fitted in the metal. This metal, generally brass, can be coated with a layer of varnish or of another electrolytically deposited noble metal. Motifs such as the Trade Marks or the minute marks can be pad printed on the dial.

Dials of this type render it very difficult to make extensive use of colour.

Dials are also known which are executed in an aluminium sheet with the upper and lower surfaces plane and parallel. These dials, notably used in watches sold under the Trade Mark SWATCH (registered Trade Mark) are covered with a decoration in several colours by means of silk screen printing or transfer processes.

It is also possible to make dials of organic materials, of plastics material for example. This solution has hitherto only been used for inexpensive watches. It has, indeed, been found that this type of material lacks rigidity and that it is consequently easily deformed when certain parameters such as temperature or relative humidity change. Depending on the way in which the dial is fixed, these deformations can cause disengagement of the hour wheel or even stripping of the hands.

SUMMARY OF THE INVENTION

It is an object of the present invention to enable the use or organic materials for the manufacture of dials without affecting the reliability of the watch.

According to the instant invention therefore there is provided a watch having a case with a glass, a case band and a back, a movement, hands, a dial and means for positioning the dial in the watch, wherein the positioning means have a first part fixed and positioned axially, radially and angularly in the case and defining an annular groove which opens towards the axis of the hands as well as an angular stop and a second part integral with the dial arranged at the periphery thereof so as to engage with play in the groove to ensure the axial positioning of the dial, this second part being provided with an angular counter stop cooperating with play with the stop to ensure the angular positioning of the dial.

It has been found that the special configuration of the dial positioning means of the dial of the watch as claimed make it possible to eliminate any flexion of the dial, with the result that they allow for radial deformation whilst still positioning the dial precisely, both angularly and axially.

The use of organic materials for the manufacture of dials is an inexpensive solution which, moreover, opens up many new possibilities both from the aesthetic and technical point of view. Aesthetically it is thus possible to produce dials using photographic processes with very varied decorations, more so than is, for example, possible by silk screen printing. From the technical point of view, certain thin sheet organic materials, such as polyester for example constitute a carrier which is well suited for photographic emulsion and permit both sufficient rigidity to provide the necessary stability of shape to a dial and a flexibility permitting assembly line working, up to the operation of insertion into the watch. To this is added an economic advantage. The price of a dial manufactured as described above by photographic means is less than that of a dial made by a single silk screen printing process. Hitherto the manufacture of a fantasy dial required three to six successive printing passes. Organic materials also make it possible to produce three dimensional dials by heat moulding, which is much more difficult to realise using metal dials.

BRIEF DESCRIPTION OF THE DRAWINGS

The invention will be better understood from a study of the following description, with particular reference to the following drawings. The embodiments given in the drawings are for purpose of illustration only and shall in no way be deemed to limit the invention as defined in the claims appended hereto FIGS. 1 and 2 respectively represent sectional and plan views of a watch of a first embodiment of the invention.

DETAILED DESCRIPTION OF PREFERRED EMBODIMENTS

Figure 1:
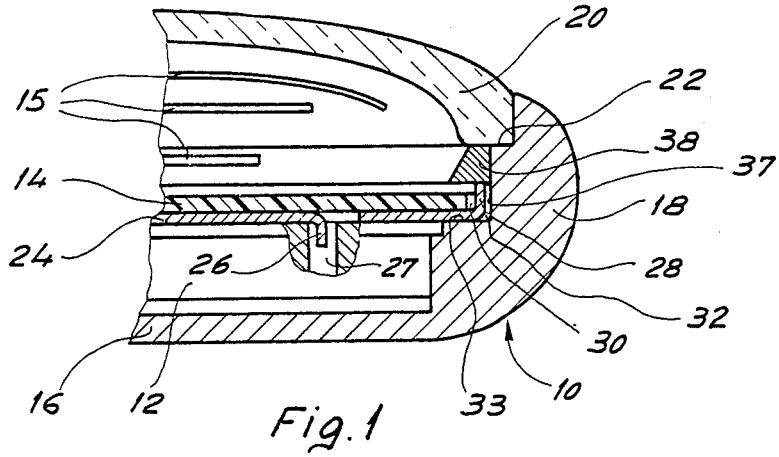
Figure 2:
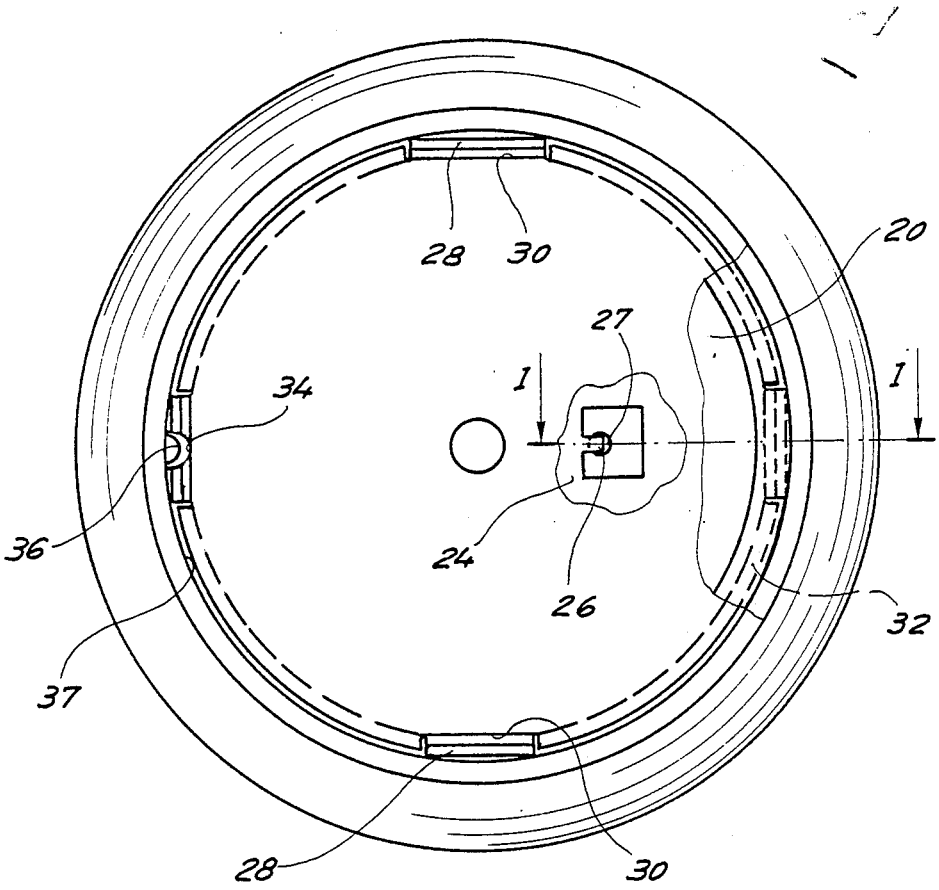

FIGS. 1 and 2 show a watch with a case 10, a movement 12, a dial 14 and hands 15.

The case 10, for example in aluminium alloy, has a back 16 and a case band 18 formed in a single piece, and a glass 20 engaged in the case band and resting against an annular planar surface 22 of this latter. The dial 14 is mounted on the movement 12 by means of a dial support 24. The latter is formed from a thin metal plate, for example of 0.15 mm thick steel, having bent parts.

More precisely, the support 24 has in its central part two tongues 26 extending perpendicularly to the plane of the watch towards the inside of the movement. These tongues 26 engage in holes 27 of the movement 12 which, in conventional constructions, are adapted to receive the pins of the dial. Only one tongue 26 and one hole 27 are shown in FIGS. 1 and 2.

In addition the periphery of the support 24 has four curved parts spaced evenly apart and extending towards the front of the watch to form pins 28 which form an angular stop. The height of the pins 28 is slightly greater than the thickness of the dial 14. The latter has cut-away portions 30 into which the pins 28 engage to ensure the correct angular positioning of the dial 14 and which form an angular counter stop by cooperating with the pins 28.

The support 24 is accommodated in a hollow 32 of the case band with its periphery resting against the base 33 of the hollow 32. The support 24 also has a cut-away portion 34 provided in one of the pins 28 and into which penetrates a boss 36 projecting from the side 37 of the hollow 32 and integral with the case band.

A ring (38) is interposed between the glass 20 and the pins ((28) as a flange.

In this manner the support 24 is positioned and fixed radially by the side 37 of the hollow 32, axially by the base 33 and the ring 38 and angularly by the boss 36, whilst the dial 14 is positioned axially, with a little play, by the support 24 and the ring 38 which together define an annular groove opening towards the axis of the hands. In addition, the dial is also positioned angularly with a little play by means of the pins 28, these pins thus not interfering with radial deformation of the dial.

It is clear that in FIG. 1 the space between the ring 38 and the dial 14 has been exaggerated in order to simplify study of the drawing.

Alternatively, the support 24 could be in a soft magnetic material thus functioning as a magnetic screen.

It should also be stressed that the support 24 thus serves as positioning means not only for the dial, but also for the movement 12 in the case 10. There is thus no need for a fitting ring.

The manufacture of the dials will be considered in greater detail below.

Figure 3:
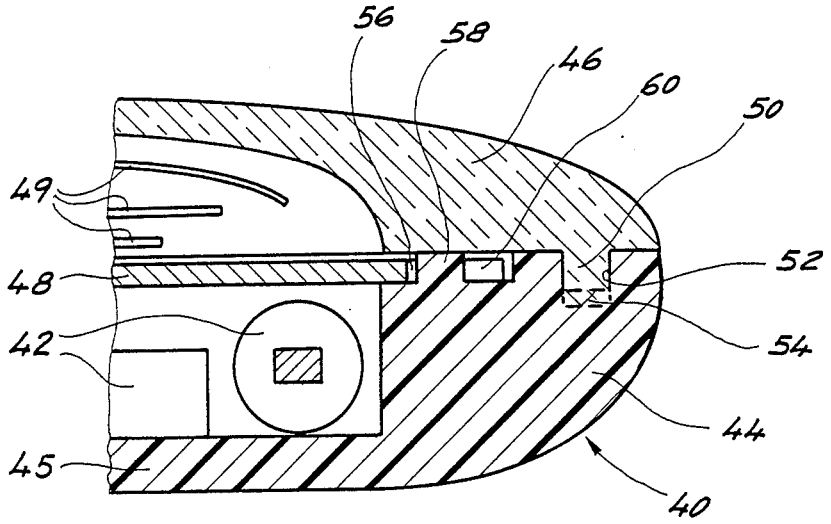
FIGS. 3 and 4 illustrate a watch according to a second embodiment of the invention, also in section and in plan
Figure 4:
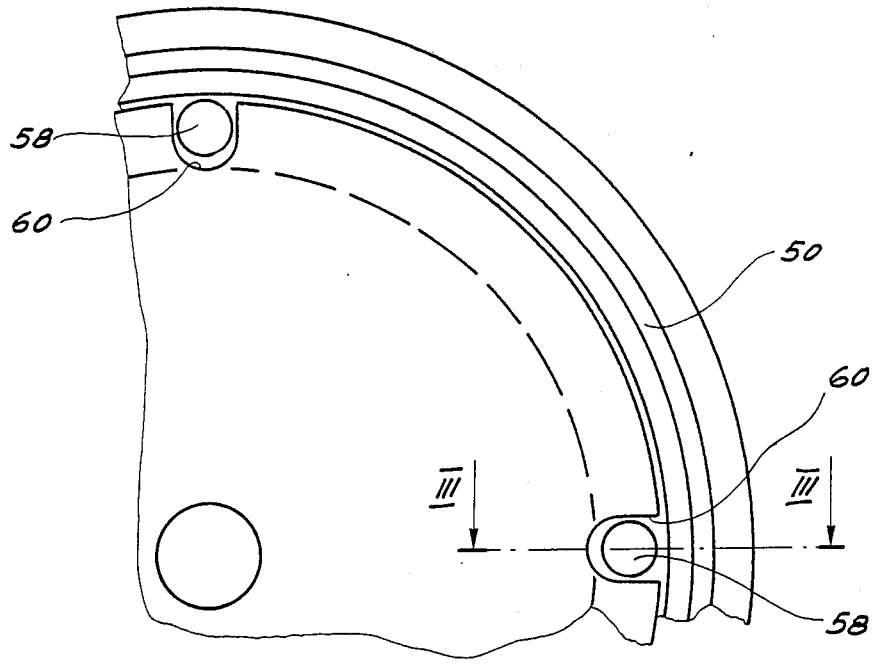

In the second embodiment shown in FIGS. 3 and 4 the watch has a case 40 forming a bottom plate into which are fixed different modules, schematically represented by 42. This case 40 comprises a case band 44 fabricated in one piece with a back 45 as well as a glass 46. A dial 48 covers the modules 42. The time is shown by means of hands 49.

The glass 46 and the case band 44 are made from materials capable of being thermowelded and are welded to one another. More precisely, the glass 46 has a rib 50 which engages in a groove 52 of the case band. During the welding operation, for example by means of ultrasound, the portion of the annular extremity of the rib 50 and the base of the groove 52 become hot and together form an area 54 ensuring the firm fixing of the glass 46 to the case band 44. In this area 54 the materials forming the glass 46 and the case band 44 flow into one another by the welding process.

The case band 44 has an annular hollow 56 the depth and diameter of which are slightly greater than the thickness and diameter respectively of the dial. Projecting from the base of the hollow 56 are two bosses 58 the height of which is equal to the depth of the hollow 56 and placed at 12 and at 3 o'clock each boss forming an angular stop as in the first embodiment.

The hollow 56 is covered by the glass 46, thereby defining an annular groove 57 in which the dial 48 is retained. The dial 48 also has two cut-away portions 60, each gripping one of the bosses 58 and extending radially towards the inside of the dial. These cut-away portions 60 form an angular counter stop and, in cooperation with the bosses 58, angularly position the dial, but without preventing a radial deformation thereof.

The dial 48 situated in the hollow 56 is held in position axially by the base of the hollow 56 and the lower face of the glass 46.

Alternatively, the dial 48 can advantageously be fixed to the case band by a drop of glue. In this instance the case band need have only one boss 58. This drop of glue simplifies the assembly of the watch without preventing radial deformation of the dial.

We claim:

1. A watch comprising a case with a glass, a case band, a back, a movement, hands, a dial and positioning means for positioning the dial in the case; said positioning means comprising a first and a second part, said first part being rigid with the case and defining an annular groove as well as an angular stop, said annular groove opening towards the axis of the hands, said second part being integral with the dial and engaged in said annular groove to ensure axial positioning of the dial, said second part being provided with an angular counter stop so arranged as to cooperate with said angular stop to ensure an angular positioning of the dial, said second part and said angular counter stop being arranged to cooperate, with play, respectively with said groove and said angular stop, whereby said first and said second part of said positioning means are loosely fitted together and allow radial deformation of the dial while still positioning the dial both angularly and axially.

2. A watch according to claim 1, wherein said first part comprises a dial support immobilized in the case band and formed by a sheet of metal with, on its periphery, pins which extend axially in the direction of the glass and whose height defines the width of the groove;

and a ring resting on the pins and retained by the glass whereby at least one of the pins constitutes the angular stop; and wherein the dial has at least one cut-away portion forming said angular counter-stop cooperating with said angular stop.

3. A watch according to claim 1, wherein the case band and the glass are of thermoweldable plastics material and define the groove, wherein the angular stop is formed by a boss integral with the case band, and wherein the dial has a cut-away portion into which the boss penetrates and which defines said angular counter atop.

4. A watch according to claim 3, wherein the dial has two cut-away portions angularly staggered at 90° one to another and in that the case band has two bosses each cooperating with one of the cut-away portions.

5. A watch according to claim 3, wherein the dial is also fixed to the case by means of a drop of glue diametrically opposed to the boss.

6. A watch according to claims 1 2, 3, 4 or 5, wherein the upper face of the dial is covered with a photograph.

7. A watch having a case, a glass, a case band, a back, a movement, hands and a dial, said watch having positioning means for positioning the dial in the case, said positioning means comprising a first part and a second part, said first part of said positioning means being fixed and positioned axially, radially and angularly in the said case and whereby said first part constitutes an annular groove open towards the axis of the hands as well as first angular stop, said second part of said positioning means being integral with said dial and disposed at the periphery thereof, said first and second parts being so dimensioned that the second part fits with play into the first part to ensure axial positioning of the dial, said second part being provided with an angular counterstop which cooperates with play with said first angular stop, said first and second stops being adapted to cooperate with play with each other to ensure correct angular positioning of the dial.

* * * * *